US006873933B1

(12) United States Patent
Lang

(10) Patent No.: US 6,873,933 B1
(45) Date of Patent: Mar. 29, 2005

(54) METHOD AND APPARATUS FOR ANALYZING COAL CONTAINING CARBON DIOXIDE PRODUCING MINERAL MATTER AS EFFECTING INPUT/LOSS PERFORMANCE MONITORING OF A POWER PLANT

(75) Inventor: Fred D Lang, San Rafael, CA (US)

(73) Assignee: Exergetic Systems LLC, San Rafael, CA (US)

( * ) Notice: Subject to any disclaimer, the term of this patent is extended or adjusted under 35 U.S.C. 154(b) by 820 days.

(21) Appl. No.: 09/971,527

(22) Filed: Oct. 5, 2001

Related U.S. Application Data

(63) Continuation-in-part of application No. 09/827,956, filed on Apr. 4, 2001, now Pat. No. 6,560,563, which is a continuation-in-part of application No. 09/759,061, filed on Jan. 11, 2001, now abandoned, which is a continuation-in-part of application No. 09/630,853, filed on Aug. 2, 2000, now Pat. No. 6,584,429, which is a continuation-in-part of application No. 09/273,711, filed on Mar. 22, 1999, now Pat. No. 6,522,994, and a continuation-in-part of application No. 09/047,198, filed on Mar. 24, 1998, now abandoned, application No. 09/971,527.

(60) Provisional application No. 60/313,308, filed on Aug. 18, 2001, and provisional application No. 60/147,717, filed on Aug. 6, 1999.

(51) Int. Cl.[7] ..... G06F 11/30

(52) U.S. Cl. ..... 702/183; 700/287

(58) Field of Search ..... 702/183; 700/287, 700/274; 110/347; 431/12

(56) References Cited

U.S. PATENT DOCUMENTS

| | | | | |
|---|---|---|---|---|
| 4,531,905 A | * | 7/1985 | Ross | 431/12 |
| 5,367,470 A | * | 11/1994 | Lang | 700/274 |
| 5,488,916 A | * | 2/1996 | Bozzuto | 110/347 |
| 5,790,420 A | * | 8/1998 | Lang | 700/287 |

* cited by examiner

*Primary Examiner*—John Barlow
*Assistant Examiner*—Xiuqin Sun

(57) ABSTRACT

The operation of a fossil-fueled thermal system such as a power plant or steam generator is quantified by obtaining the amount of carbon dioxide produced from inorganic materials and, with this information, applying corrections to processes related to the Input/Loss Method and similar methods.

19 Claims, 1 Drawing Sheet

METHOD AND APPARATUS FOR ANALYZING COAL CONTAINING CARBON DIOXIDE PRODUCING MINERAL MATTER AS EFFECTING INPUT/LOSS PERFORMANCE MONITORING OF A POWER PLANT

This application claims the complete benefit of U.S. Provisional Patent Application No. 60/313,308 filed Aug. 18, 2001.

This application is a Continuation-In-Part of U.S. patent application Ser. No. 09/273,711 filed Mar. 22, 1999 now U.S. Pat. No. 6,527,994, for which priority is claimed and is incorporated herein by reference in its entirety; application Ser. No. 09/273,711 which, in turn, is a Continuation-In-Part of U.S. patent application Ser. No. 09/047,198 filed Mar. 24, 1998, now abandoned.

This application is also a Continuation-In-Part of U.S. patent application Ser. No. 09/630,853 filed Aug. 2, 2000 now U.S. Pat. No. 6,584,429, for which priority is claimed and is incorporated herein by reference in its entirety; application Ser. No. 09/630,853 claims the benefit of U.S. Provisional Patent Application Ser. No. 60/147,717 filed Aug. 6, 1999.

This application is also a Continuation-In-Part of U.S. patent application Ser. No. 09/827,956 filed Apr. 4, 2001 now U.S. Pat. No. 6,560,563, and is incorporated herein by reference in its entirety; application Ser. No. 09/827,956 which, in turn, is a Continuation-In-Part of U.S. patent application Ser. No. 09/759,061 filed Jan. 11, 2001, now abandoned; application Ser. No. 09/759,061 which, in turn, is a Continuation-In-Part of U.S. patent application Ser. No. 09/273,711 filed Mar. 22, 1999, for which priority is claimed and is incorporated herein by reference in its entirety; application Ser. No. 09/273,711 which, in turn, is a Continuation-In-Part of U.S. patent application Ser. No. 09/047,198 filed Mar. 24, 1998, now abandoned.

This invention relates to a fossil-fired thermal system such as a power plant or steam generator, and, more particularly, to a method for determining such a system's fuel chemistry, heating value, boiler efficiency, fuel energy flow, L Factor, $F_C$ Factor, system heat rate, and related parameters when the fuel to such a system has significant amounts of carbon dioxide producing inorganic materials.

BACKGROUND OF THE INVENTION

The routine analyses of coal as a fuel for any thermal system, and especially when used for power plants and steam generators, commonly involves laboratory evaluations of samples of the fuel, including: the fuel's elementary composition free of ash and water; the fuel's ash resultant from combustion; the fuel's water, and the fuel's heating value. The combined analyses of elementary composition, fuel ash and fuel water is herein defined as an ultimate analysis. These evaluations supply important data to users of coal, to operators of coal-fired power plants, and to the Input/Loss Method and its associated technologies. The Input/Loss Method and its associated technologies are described in the following United States patent applications and resulting patents: Ser. No. 09/273,711 which issued on Feb. 18, 2003 as U.S. Pat. No. 6,522,994 (hereinafter termed '711), Ser. No. 09/630,853 which issued on Jun. 24, 2003 as U.S. Pat. No. 6,584,429 (hereinafter termed '853), and Ser. No. 09/827,956 which issued on May 6, 2003 as U.S. Pat. No. 6,560,563 (hereinafter termed '956). A rudimentary Input/Loss Method is described in U.S. Pat. No. 5,367,470 issued Nov. 22, 1994 (hereinafter termed '470), and in U.S. Pat. No. 5,790,420 issued Aug. 4, 1998 (hereinafter termed '420).

A typical ultimate analysis, and as herein defined, produces the following quantities on a weight bases: carbon, hydrogen, oxygen, nitrogen, sulfur, ash resultant from combustion, and the fuel's water. Reported carbon is the total, from both organic and inorganic substances. Reported hydrogen is the total but without water's hydrogen. Reported oxygen is the total, from both organic and inorganic substances, but without water's oxygen. For reported ash, it is routine in laboratory analyses to simply weight the ash resultant after combustion of the sampled fuel; this is commonly assumed to be the fuel's mineral matter associated with the originating sample before combustion. For example, in '711 the present inventor, without the knowledge gained in developing this invention, states "By fuel ash is meant the fuel's non-combustible mineral content, before firing."This assumption is generally valid for coals, as commonly its mineral matter contains metal oxides, other non-combustible materials and non-combustible rocks. If, for example, mineral carbonates are present in coal as $CaCO_3$, which is typical, then solid CaO will result as a product of combustion to be found in the resultant ash, with production of gaseous $CO_2$ given reduction of $CaCO_3$. Thus CaO will be reported as a portion of the coal's ash. No distinction is made between $CO_2$ produced from organic matter, i.e., from the coal's organic matrix, versus from mineral carbonates. No information on $CO_2$ producing inorganic materials is routinely provided, nor routinely sought. Such $CO_2$ producing inorganic materials include mineral carbonates found in certain coals, and typically includes $CaCO_3$ and $MgCO_3$. Free $CO_2$ is also found in gaseous fuels, such as natural gas.

The Input/Loss Method described in '711 advocates determining elementary compositions of fossil fuels based on certain "operating parameters" principally including effluent measurements, and with that information to then determine the fuel's heating value and the system heat rate (note that heat rate is inversely related to system efficiency by the following: Heat Rate (Btu/kWh)=3412.1416/Efficiency). However, '711 offers no consideration as to the presence of $CO_2$ producing mineral matter found in the fuel. The Input/Loss Method and its associated technologies is dependent on at least: 1) operating parameters which include effluent measurements; 2) establishing certain "reference fuel characteristics" for determining hydrogen versus carbon, and oxygen versus carbon relationships; 3) establishing historical reference fuel characteristics for determining the L Factor used by the Input/Loss Method to correct effluent measurements; 4) determining boiler efficiency by recognizing combustible and non-combustible materials within the fuel proper (i.e., its elementary composition, fuel water and fuel ash, apart from injected limestone or other added sorbents); and 5) determining a fuel's heating value based on understanding of the fuel's oxygen to carbon ratio, elementary composition and reference fuel characteristics. The fossil fuel's elementary composition and its reference fuel characteristics are important to any method which determines fuel chemistry, fuel heating value, and/or boiler a efficiency of a fossil fired thermal system in real-time via on-line monitoring. Fuel heating value and fuel flow (resulting in total fuel energy flow), and useful system output lead to a determination of system heat rate.

It has been found when developing this invention that between 1% to 5% $CO_2$ production, per weight of As-Fired fuel, has been found in Powder River Basin coals (found in Wyoming and Montana). Such coals have also been found in Greece and China. In general, high $CO_2$ production from mineral matter may be anticipated from coals whose analyzed ash has high CaO contents, suggestive of the presence of $CaCO_3$ in the unburned fuel's mineral matter. In addition to Powder River Basin coals, this situation is common with many lignite coals. 1% $CO_2$ by weight of the As-Fired fuel adversely effects Input/Loss computed fuel heating values by 3.55%. 1% $CO_2$ by weight of the As-Fired fuel effects the oxygen to carbon ratio of coal by 9.5% on a weight base; the oxygen to carbon ratio is used for heating value predictions.

There is no known prior art for this invention. Eq.(29) found in '470, '420 and '711, describing a combustion equation, includes the quantity of gaseous $CO_2$ found in the fuel's constituents; termed $\alpha_7$. Eq.(19) found in '853, describing a combustion equation, includes the quantity of $CO_2$ found in the fuel's constituents; also termed $\alpha_7$. However, Patents '470 and '420 make no mention of any corrections nor otherwise address $CO_2$ producing inorganic materials found in fossil fuels. Applications '711, '853 and '956 and their related provisional patent applications and Continuation-In-Parts, make no mention of any corrections nor otherwise address $CO_2$ producing inorganic materials found in fossil fuels. Although the presence of limestone ($CaCO_3$) and its inclusion in combustion stoichiometrics is taught in these applications, denoted by reference as "PLS" (i.e., Pure LimeStone), $CO_2$ production from limestone is treated uniquely, apart from the fuel per se, as such limestone is injected separately into the combustion process for control of sulfur emissions; $CO_2$ production from mineral matter found within the fuel is not mentioned.

SUMMARY OF THE INVENTION

This invention presents a method and apparatus to obtain and correctly use the quantity of carbon dioxide created from mineral carbonates or other inorganics, or present as free $CO_2$, found in fossil fuels. The correct use of this information allows accurate determination of the L Factor and the EPA's $F_C$ Factor. Determination of L Factors and $F_C$ Factors is dependent on the fuel's elementary composition and the fuel's heating value, which when corrected, as taught by this invention, improves the accuracy of said factors. L Factors are based on historical data, and when used with the Input/Loss Method allow correction of the operating parameters including combustion effluent signals. With such corrections the Input/Loss Method may more accurately determine the total fuel energy flow of a fossil-fired thermal system resulting, when divided by the measured system's useful output, in a determination of the heat rate of the system. From these determinations changes in heat rate, dependent on corrected effluent measurements, may be monitored on-line with higher accuracy and actions taken to improve and/or correct degradations found in the system in a continuous manner.

This invention teaches how the carbon dioxide content, as produced from inorganic material, typically carbonate bearing mineral matter found in certain coals, may be determined and used to improve the accuracy in determining and/or analyzing fuel chemistry, fuel heating value and system heat rate. If not correctly analyzed, the presence of carbon dioxide produced from mineral matter may adversely effect the computational stoichiometric balance of fossil combustion and thus computed heating values. Improvements in the determinations of fuel chemistry, fuel heating value and system heat rate may be realized using the methods of this invention by accounting for the presence of $CO_2$ when arising from inorganic materials.

DESCRIPTION OF THE PREFERRED EMBODIMENT

Figure 1:
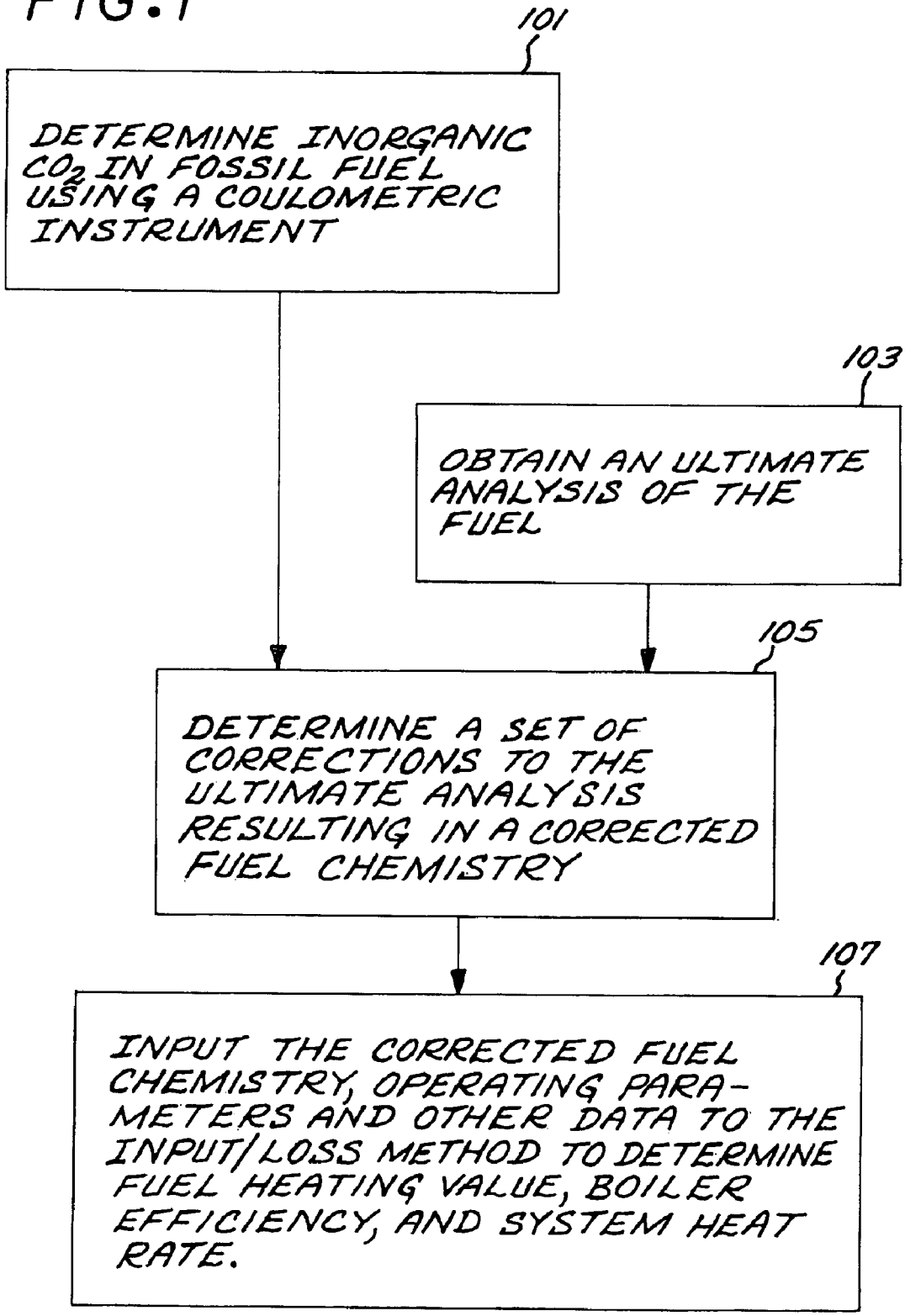
FIG. 1 is a block diagram illustrating the procedures involved in determining the effects on fuel chemistry given $CO_2$ production from a fossil fuel's inorganic materials.

The importance of determining the heat rate of a fossil fueled thermal system, and particularly for a power plant or steam generator, is critical if practical hour-to-hour improvements in heat rate are to be made, and/or problems in thermally degraded equipment are to be found and corrected.

It is well known that certain coals contain carbon bearing inorganic materials such as $CaCO_3$ and $MgCO_3$, which produce $CO_2$ upon combustion. It is well known that natural gas and other gaseous fuels may contain free $CO_2$. However, this invention uniquely expands related work, particularly '711, '853 and '956, by recognizing that corrections must be made when computing the fuel's chemistry if this chemistry is based on $CO_2$ measured in the system's effluent. Measured effluent $CO_2$ is composed of carbon deriving from both organic material (e.g., from the coal's organic matrix) and from inorganic carbon materials (e.g., mineral carbonates). When determining correct As-Fired fuel chemistry, both organic and inorganic sources of $CO_2$ must be recognize Information as to $CO_2$ producing inorganic materials is lost if fossil fuel samples are only analyzed for their ultimate analyses and heating values. However, to obtain information on $CO_2$ producing inorganic materials found in solid fuels, at least two laboratory processes may be used: American Society for Testing and Materials (ASTM) standard D1756; and/or a carbon dioxide Coulometer instrument for determining total inorganic carbon. These are practical procedures applicable for routine industrial use for coals. Gaseous fuels may be routinely analyzed for $CO_2$ using gas chromatography. The preferred embodiment of this invention for solid fuels is to use a carbon dioxide Coulometer instrument which measures total inorganic carbon as $CO_2$, including that from mineral carbonates. The preferred Coulometer is Model CM140 manufactured by UIC, Inc. of Joliet, Ill. (www.UICINC.com), or an instrument with equivalent accuracy, resolution and throughput. Ideally, Model CM140 should be used with at least 250 mg samples, with 0.1% resolution requiring 12 to 15 minutes per sample. Also, it is the preferred embodiment to express $CO_2$ produced from inorganic materials as a fuel weight fraction, i.e., weight of $CO_2$ per total weight of the originating sample.

When obtaining the quantity of $CO_2$ produced from inorganic materials, routine ultimate analysis of the fuel and heating value determinations by laboratory analyses should be completed at the same time. The preferred embodiment involves well mixing the originating sample, then carefully dividing the sample for determinations of inorganic $CO_2$ production, for ultimate analysis including fuel water and the resultant ash from combustion (i.e., the fuel's chemistry), and for heating value; or otherwise divided as needed for these analyses. Proper mixing and division of the originating sample is very important as both ASTM D1756 and Coulometer analyses destroy the sample; subsequent testing must be completed using a valid representation such that inorganic $CO_2$ corrections may be applied consistently to other laboratory results. Laboratory preparation procedures, and testing of fossil fuels for its chemistry, is well established art having a history which reaches well back into the last century. Such established art has been memorialized in ASTM International standards (www.astm.org). The following ASTM standards are the more popular ones used by the power industry in North America regards preparation and ultimate analyses: for preparing coal and coke for testing D346, D2013; for preparing gaseous fuel for testing D5287, D5503; for preparing fuel oil for testing D4177; for chemistry of coal and coke D3173, D3174, D3176, D3302, D4239, D5373; for chemistry of gaseous fuel D1945; and for chemistry of fuel oil D482, D1744, D4294, D5291.

Having obtained this laboratory information, the following $CO_2$ corrections are made to the ultimate analysis of fossil fuel. Note that the symbol $WF_i$ is the weight fraction of substance i in the As-Fired fuel; the symbol $\alpha_i$ is the molar fraction of substance i in the As-Fired fuel; $N_i$ is the molecular weight of substance i. Also, in these relationships the following subscripts are used: C for carbon, H for hydrogen, O for oxygen, N for nitrogen, S for sulfur, Ash for the solid product resultant from the sample's combustion, H2O for the fuel's moisture (water), CO2 for carbon dioxide, and O2 for diatomic oxygen.

An ultimate analysis with ash and fuel water, as typically reported by laboratories, whose individual substances sum to unity, is represented by the following:

$$1.0=WF_C+WF_H+WF_O+WF_N+WF_S+WF_{Ash}+WF_{H2O} \quad (1)$$

This invention teaches that Eq.(1) must be corrected by the following. Note that $WF_{CO2}$. is the weight faction of $CO_2$ produced from the fuel's inorganics, determined by laboratory analysis as described.

$$1.0=(WF_C-WF_{CO2}N_C/N_{CO2})+WF_H+(WF_O-WF_{CO2}N_{O2}/N_{CO2})+WF_N+WF_S+W_{Ash}+WF_{CO2}+WF_{H2O} \quad (2)$$

The corrected fuel carbon is given by the following: its weight fraction on an As-Fired base, $WF_{C\text{-}corr}$; its molar fraction, $\alpha_{4\text{-}corr}$ on an As-Fired base; and its molar fraction, $\alpha_{MAF\text{-}4\text{-}corr}$ on a Moisture-Ash-Free (MAF) base:

$$WF_{C\text{-}corr}=WF_C-WF_{CO2}N_C/N_{CO2} \quad (3A)$$

$$\alpha_{4\text{-}corr}=\alpha_4-\alpha_{CO2} \quad (3B)$$

$$\alpha_{MAF\text{-}4\text{-}corr}=\alpha_{MAF\text{-}4}-\alpha_{MAF\text{-}CO2} \quad (3C)$$

In these relationships the quantities $\alpha_4$ and $\alpha_{MAF\text{-}4}$ are the moles of uncorrected carbon (based on the original laboratory's ultimate analysis) on an As-Fired and MAF base. $\alpha_{CO2}$ and $\alpha_{MAF\text{-}CO2}$ are discussed below.

The corrected fuel oxygen is given by the following: its weight fraction on an As-Fired base, $WF_{O\text{-}corr}$; its molar fraction, $\alpha_{3\text{-}corr}$ on an As-Fired base; and its molar fraction, $\alpha_{MAF\text{-}3\text{-}corr}$ on a MAF base:

$$WF_{O\text{-}corr}=WF_O-WF_{CO2}N_{O2}/N_{CO2} \quad (4A)$$

$$\alpha_{3\text{-}corr}=\alpha_3-\alpha_{CO2} \quad (4B)$$

$$\alpha_{MAF\text{-}3\text{-}corr}=\alpha_{MAF\text{-}3}-\alpha_{MAF\text{-}CO2} \quad (4C)$$

In these relationships the quantities $\alpha_3$ and $\alpha_{MAF\text{-}3}$ are moles of uncorrected diatomic oxygen ($O_2$, based on the original laboratory's ultimate analysis) on an As-Fired and MAF base.

The corrected fuel's mineral matter, denoted by $WF_{Ash\text{-}corr}$, is given by Eq.(5). Note, again, that commonly the As-Fired quantity $WF_{Ash}$, or its molar equivalent termed $\alpha_{10}$, would be taken as the fuel's mineral matter using prior art.

$$WF_{Ash\text{-}corr}=WF_{Ash}+WF_{CO2} \quad (5)$$

TABLE 1 demonstrates corrections for a coal containing 1% $CO_2$ produced from the fuel's inorganics. As examples of the sensitivities to the Input/Loss Method, the fuel chemistries presented in this table, uncorrected and corrected, cause a 0.123% difference in the computed L Factor, and a 3.55% difference in computed fuel heating value (12340.18 versus the measured 11197.00 Btu/lbm). Note that as taught in '956, standard deviations in $L_{Fuel}$ for coals are typical less than 0.05%; thus the deviation in the computed L Factor is increased by a factor of 2.5.

TABLE 1

Example of Weight Fractions from Laboratory Reported Results versus Corrected Analysis for a High Ash Coal

| Substance | Lab. Reported Chemistry | Corrected for $CO_2$ Effects |
|---|---|---|
| Carbon | 60.56 | 60.27 |
| Hydrogen | 5.40 | 5.40 |
| Oxygen | 8.43 | 7.66 |
| Nitrogen | 1.30 | 1.30 |
| Sulfur | 0.63 | 0.63 |
| Ash | 15.66 | 15.66 |
| Carbon Dioxide | 0.00 | 1.06 |
| Water | 8.02 | 8.02 |
| Totals | 100.00 | 100.00 |
| Computed L Factor | 732.81463 | 731.91497 |

Correcting the L Factor, whose fundamentals are taught in '711 (termed the $L_{Fuel}$ parameter in '711), and in '956, is accomplished by the following relationships. Eq.(72) of '711 and Eq.(72A) of '956 are both replaced, and thus corrected, by the following:

$$L'_{Fuel}=[X_{Dry\text{-}theor}N_{Dry\text{-}Fuel}+a_{Dry\text{-}theor}(1.0+\phi_{Ref})N_{Dry\text{-}Air}-J_{theor}N_{H2O}-x_{MAF\text{-}theor}\alpha_{MAF\text{-}10}N_{Ash}-x_{MAF\text{-}theor}\alpha_{MAF\text{-}CO2}N_{CO2}]/(x_{Dry\text{-}theor}N_{DryFuel}HHV_{Dry}) \quad (72A\text{-corr})$$

Eq.(74) of '711 teaches about the $L_{Ash}$ term whose use may result in the determination of fuel mineral matter by correcting the system's indication of Air/Fuel ratio. If $L_{Ash}$ is used to determine the total mineral matter found in unburned fuel, including for example any mineral carbonates, then Eq.(74) of '711 is replaced, and thus corrected, by the following:

$$L_{Ash}=[x_{MAF\text{-}theor}\alpha_{MAF\text{-}10}N_{Ash}+x_{MAF\text{-}theor}\alpha_{MAF\text{-}CO2}N_{CO2}]/(x_{Dry\text{-}theor}N_{Dry\text{-}Fuel}HHV_{Dry}) \quad (74\text{-corr})$$

When teaching L Factor methods, Eq.(80) of '956 is replaced, and thus corrected, by the following:

$$[x_{Dry\text{-}theor}N_{Dry\text{-}Fuel}+a_{Dry\text{-}theor}(1.0+\phi_{Ref})N_{Dry\text{-}Air}-J_{theor}N_{H2O}-x_{MAF\text{-}theor}\alpha_{MAF\text{-}10}N_{Ash}-x_{MAF\text{-}theor}\alpha\text{MAF-CO2}N_{CO2}]=100\ x_{Dry\text{-}theor}N_{DryGas/theor} \quad (80\text{-corr})$$

$$[x_{Dry\text{-}theor}N_{Dry\text{-}Fuel}+a_{Dry\text{-}theor}(1.0+\phi_{Ref})N_{Dry\text{-}Air}-J_{theor}N_{H2O}-x_{MAF\text{-}theor}\alpha_{MAF\text{-}10}N_{Ash}-x_{MAF\text{-}theor}\alpha\text{MAF-CO2}N_{CO2}]=100N_{DryGas/theor} \quad (80\text{-corr})$$

Subsequent use of Eq.(80) in '956 also includes this correction as taught though Eq.(80-corr), including but not limited to, Eqs.(94) and (95) in '956.

In Eqs.(3C), (4C), (72A-corr), (74-corr) & (80-corr) the term $\alpha_{MAF\text{-}CO2}$ is the molar carbon dioxide quantity produced from the fuel's inorganic material on a Moisture-Ash-Free (MAF) base. $\alpha_{MAF\text{-}CO2}$ derives from the As-Fired value termed either $\alpha_7$ or $\alpha_{CO2}$ (considered equivalent); other terms in these equations are defined in '711 and '956. In these equations, the dried fuel term, $x_{Dry\text{-}theor}N_{Dry\text{-}Fuel}$, employs all non-water constituents of the fuel, including $CO_2$ from inorganic materials. The effluent term, based on 100 moles of dry gas, $100x_{Dry\text{-}theor}N_{DryGas/theor}$-$100N_{DryGas/theor}$-, as taught herein is composed of terms which produce gases directly from combustion of organic materials, not $CO_2$ produced from inorganic materials. Thus the molecular weight of the dry effluents, $N_{DryGas/theor}$, used in Eq.(80-corr) consists of the following: effluent $CO_2$ derived solely from organic carbon (i.e., the coal matrix, the inorganic carbon is ignored); effluent $SO_2$; and effluent $N_2$. These terms and others contained in Eqs.(72A-corr), (74-corr) and (80-corr) are based on the assumptions of theoretical combustion as is common art, the teachings of '711 and '956, conditions and assumptions effecting theoretical combustion as taught herein, the corrected fuel carbon of Eq.(3B), and the corrected fuel oxygen of Eq.(4B). The Moisture-Ash-Free molar fuel ash, $\alpha_{MAF\text{-}10}$, is the uncorrected ash, as determined from $WF_{Ash}$; refer to Eq.(29) of '711 for general usage involving this term on an As-Fired molar base, termed $\alpha_{10}$. The Moisture-Ash-Free molar carbon dioxide quantity produced from the fuel's inorganics, $\alpha_{MAF\text{-}CO2}$, is determined from $WF_{CO2}$; refer to Eq.(29) of '711 and/or Eq.(19) of '853, for general usage involving this term on an As-Fired molar base, termed $\alpha_7$ in both works. As a conceptual fundamental, the L Factor and EPA's $F_C$ Factor are based on the relationship between effluent $CO_2$ produced solely from organic carbon to the fuel's measured heating value, requiring the corrections as taught herein if inorganic $CO_2$ is present.

In the above equations and in other expressions herein, the following nomenclature and descriptive meanings apply:

a=Moles of combustion $O_2$ input to the system; moles/base.

aβ=$O_2$ entering with system air leakage (typically via the air pre-heater); moles/base.

$a_{DRY\text{-}theor}$=Moles of combustion $O_2$ input to the system required for theoretical combustion associated with Dry (water free) fuel; moles/base.

$A_{Act}$=Concentration of $O_2$ in combustion air local to (and entering) the system; molar fraction.

$b_A$=Moisture in the entering combustion air, moles/base.

$b_A\beta$=Moisture entering with system air leakage; moles/base.

$b_{PLS}$=Moles of Pure LimeStone [$CaCO_3$] required for zero CaO production; moles/base.

$b_Z$=Moles of known water in-leakage entering and mixing with the combustion gases; moles/base.

$d_{Act}$=Actual total effluent $CO_2$ at the system's boundary; moles/base.

$d_{theor}$=Total effluent $CO_2$ at the system's boundary based on theoretical combustion, without system air leakage nor influenced by $CO_2$ production from mineral matter; moles/base.

$ER_{CO2}$=Emission rate for $CO_2$; (lbm dry $CO_2$ effluent)/million-$Btu_{Fuel}$.

$F_C$=$F_C$ Factor defined by 40CFR Part 60, Appendix A, Method 19.

HHV=As-Fired higher heating value; $Btu/lbm_{AF}$.

$HHV_{Dry}$=Dry higher heating value; $Btu/lbm_{Dry}$.

$J_{theor}$=Total moles of effluent water at the boundary based on theoretical combustion; moles/base.

$L_{ash}$=Specialized L Factor for fuel ash; (lbm dry gaseous effluent)/million-$Btu_{Fuel}$.

$L'_{Fuel}$=L Factor for dry gaseous effluents; (lbm dry gaseous effluent)/million-$Btu_{Fuel}$.

$m_{DryGas/theor}$=Mass flow rate of dry gaseous effluent from the thermal system based on theoretical combustion; lbm/hr.

$N_k$=Molecular weight of compound k; e.g., $N_{AF}$ is the molecular weight of the As-Fired (wet) fuel.

$q_{DryGas/theor}$=Volumetric flow rate of dry gaseous effluent from the thermal system based on theoretical combustion; $ft^3$/hr.

$R_{Act}$=Ratio of moles of dry gas from the combustion process before entering the air pre-heater to the diluted moles of gas leaving, defined as the Air Pre-Heater Leakage Factor; molar fraction.

$WF_j$=As-Fired fuel mass fraction of fuel substance j; fraction.

x=Moles of As-fired fuel required per 100 moles of dry gaseous effluent, the solution base for Eq.(19-corr); moles/base.

$x_{theor}$=Moles of As-Fired fuel associated with theoretical combustion; moles/base.

$x_{DRY\text{-}theor}$=Moles of Dry fuel associated with theoretical combustion; moles/base.

$x_{MAF\text{-}theor}$=Moles of Moisture-Ash-Free fuel associated with theoretical combustion; moles/base.

z=Moles of $H_2O$ per mole of $CaSO_4$, supplied as input based on periodic laboratory analysis of boiler refuse; molar ratio.

γ=Molar ratio of excess $CaCO_3$ to stoichiometric $CaCO_3$ (e.g., γ=0.0 if no effluent CaO); molar ratio.

β=Air Pre-Heater Dilution Factor (ratio of air leakage to true combustion air); molar ratio.

$\beta 100(R_{Act}-1.0)/[aR_{Act}(1.0\phi_{Act})]$ $\alpha_k$=As-Fired (wet-base) fuel chemistry constituent k per mole of fuel;

$\Sigma\alpha_k$=1.0, where: k=0, 1, 2, 3-corr, 4-corr, 5, 6, 7, 8, 9, 10, CaO, CaCO3;

see Eq.(19-corr) therein for terms (e.g., k=1 refers to fuel nitrogen, etc.);

mole of k/mole of fuel.

$\alpha_{MAF\text{-}k}$=Moisture-Ash-Free (MAF) fuel constituent k per mole of MAF fuel;

$\Sigma\alpha_{MAF\text{-}k}$=1.0, where: k=0, 1, 3-corr, 4-corr, 5, 6, 7, 8, 9;

see Eq.(19-corr) therein for terms; mole of k/mole of fuel.

$\alpha_{MAF\text{-}CO2}$≡Moisture-Ash-Free (MAF) fuel constituent of $CO_2$ per mole of MAF fuel; mole of k/mole of fuel.

$\phi_{Act}$≡Ratio of non-oxygen gases ($N_2$ and Ar) to oxygen in the combustion air; molar ratio.

$\phi_{Act}$≡$(1.0-A_{Act})/AAct$ $\phi_{Ref}$=Reference ratio of non-oxygen gases (principally $N_2$ and Ar) to oxygen in the combustion air, taken as 3.7737245; molar ratio.

σ=Kronecker function: unity if $(\alpha_6+\alpha_9)>0.0$; otherwise zero if no sulfur is present in the fuel.

$\Phi_{Dry\text{-}i}$=Moles of an effluent species on a dry-base; moles/base.

$\Xi_{AF}$=Correction factor for the L Factor ($L'_{Fuel}$), principally converting conditions associated with theoretical combustion to those associated with the As-Fired, discussed further in '956; unitless.

Subscript "Act"=Actual value obtained from the operating thermal system.

Subscript "AF"=As-Fired fuel at the system boundary (i.e., wet with water and inert matter).

Subscript "Dry"=Dry chemical base (i.e., free of water).

Subscript "MAF"=Moisture-Ash-Free base (i.e., free of water and free of inert matter).

Subscript "Ref"=Reference value.

Subscript "theor"=Refers to conditions associated with theoretical combustion.

In '956 as relating to L Factor and $F_C$ Factor methods, relationships involving the flow of dry combustion gases based on theoretical combustion, termed $m_{DryGas/theor}$ or $q_{DryGas/theor}$, must be determined based on the fuel's composition without consideration to $CO_2$ produced from inorganic material. The U.S. Environmental Protection Agency's F Factor as based on carbon, termed $F_C$, as defined computationally in 40CFR Part 60, Appendix A, Method 19, must, as taught herein, be determined based solely on the fuel's organic carbon. The fuel's heating value derives from the fuel's organics. In '956 the L Factor's and the $F_C$ Factor's fundamentals are based on the relationship between effluent $CO_2$, as taught herein, as produced solely from organic carbon, termed $d_{theor}$ in '956, to its measured heating value thus the corrections necessitate by Eq.(80-corr), and the assumptions and conditions associated. Although the EPA may force the use of traditional, and uncorrected, ultimate analyses in determining $F_C$, its subsequent use to compute emission rates for a fossil fuel, and especially for a coal bearing mineral carbonate, is flawed. Traditional ultimate analyses should be corrected for inorganic $CO_2$ contributions, which during study of coals for this invention, has been found to correlate well to the fuel's reported ash content. It has been learned that by characterizing the fuel with a few laboratory analyses, corrections may be determined and applied to $F_C$ calculations. Although '956 teaches the fundamentals of the L Factor and the $F_C$ Factor, this invention teaches a greater sophistication in understanding a fossil fuel's chemistry and by the impact of $CO_2$ producing inorganic materials.

For emission rates of non-$CO_2$ pollutants, Eqs.(104), (105) and (106) of '956, and Eq.(70B) of '711, and their associated discussions apply without correction in form, noting however that terms used in these equations must comply with the teachings of this invention. For emission rates of effluent $CO_2$, the total emission rate is composed of that determined using the L Factor or $F_C$ Factor, computed without $CO_2$ contributions from inorganics, plus $CO_2$ contributions from inorganics. To compute the emission rate for total effluent $CO_2$, add the inorganic contribution to those relationships taught in '711, '956 and in 40CFR Part 60, Appendix A, Method 19. For example, the emission rate for $CO_2$ ($ER_{CO2}$) is computed by replacing, and thus correcting, Eq.(106) of '956 by the following yielding pounds-$CO_2$ per million-$Btu_{Fuel}$:

$$ER_{CO2}=N_{DryGas/theor}F_C\Xi_{AF}\Phi_{Dry\text{-}i}N_i/(385.321\ d_{theor}\ N_{DryGas/Act})+10^6\ WF_{CO2}/HHV \quad \text{(106-corr)}$$

From the teachings of this invention it becomes apparent that corrections for $CO_2$ producing inorganic materials, and especially those corrections illustrated by Eqs.(72A-corr), (74-corr), (80-corr) and (106-corr), may be applied to a number of individual processes described in '711, '853 and '956. The nature of these corrections adjust formulations by the addition of terms whose quantity is based on laboratory measurements of the inorganic produced $CO_2$, specifically $WF_{CO2}$. This approach anticipates that laboratory results may be routinely and easily obtained, it is the preferred embodiment In Eq.(29) of '711 and Eq.(19) of '853, $\alpha_4$ is replaced by $\alpha_{4\text{-}corr}$, $\alpha_3$ is replaced by $\alpha_{3\text{-}corr}$, and, for the preferred embodiment, the $\alpha_7$ term is taken as the $CO_2$ production from inorganics (and equivalent to $\alpha_{CO2}$, as deriving from $WF_{CO2}$) Such corrections may be applied throughout '711, '853 and '956.

However, corrections to Eq.(29) of '711 and Eq.(19) of '853 may also be made by directly considering the presence of the $CO_2$ producing inorganic substances, for example calcium carbonate in the fuel's mineral matter. As an example of this, Eq.(19) of '853 may be replaced, and thus corrected if using this technique, by the following:

$$\begin{aligned}
&x[\alpha_0[C_{YR}H_{ZR}]+\alpha_1[N_2]+\alpha_2[H_2O]+\alpha_{3-corr}[O_2]+ \\
&\alpha_{4-corr}[C]+\alpha_5[H_2]+\alpha_6[S]+\alpha_7[CO_2]+ \\
&\alpha_8[CO]+\alpha_9[H_2S]+\{\alpha_{10}-\alpha_{CaO}\}[Ash]+ \\
&\alpha_{CaCO3}[CaCO_3]]_{As-Fired\ Fuel}+b_Z[H_2O]_{In-Leakage}+ \\
&[(1.0+\beta)(a[O_2]+a\phi_{Act}[N_2]+b_A[H_2O])]_{Air}+ \\
&[(1.0+\gamma)b_{PLS}[CaCO_3]]_{As-Fired\ PLS}= \\
&d_{Act}[CO_2]+g_{Act}[O_2]+h[N_2]+j_{Act}[H_2O]+ \\
&k_{Act}[SO_2]+[e_{Act}[CO]+f[H_2]+ \\
&1[SO_3]+m[NO]+p[N_2O]+q[NO_2]+ \\
&t[C_{YP1}H_{ZP1}]+u[C_{YP2}H_{ZP2}]]_{Minor\ Components}+ \\
&x\alpha_{10}[ash]+\sigma b_{PLS}[CaSO_4\cdot zH_2O]+ \\
&[\{(1.0-\sigma+\gamma)b_{PLS}+x\alpha_{CaCO3}\}[CaO]]_{Excess\ PLS}+ \\
&v[C_{Refuse}]+ \\
&[\beta(a[O_2]+a\phi_{Act}[N_2]+b_A[H_2O])]_{Air\ Leakage}
\end{aligned} \quad \text{(19-corr)}$$

The combustion effluent $CO_2$ term, $d_{Act}$, contains contributions from both organic and inorganic carbon. The reactant stoichiometrics of Eq.(19-corr) include the $\alpha_{CaCO3}$ term, which is the As-Fired molar concentration of $CaCO_3$ found in the fuel, apart from the uncorrected fuel ash, $\alpha_{10}$. For this correction technique the $\alpha_7$ term is not used unless gaseous $CO_2$ is present. $\alpha_{CaCO3}$ is determined from $WF_{CO2}$. One mole of $CaCO_3$ produces one mole of CaO, thus $\alpha_{CaO}=\alpha_{CaCO3}$ as required to reduce the reported ash by the CaO content In Eq.(19-corr), the product stoichiometrics are altered with the $\{(1-\sigma+\gamma)b_{PLS}+x\alpha_{CaCO3}\}$ term, assuming a relatively small amount of $CaCO_3$ found in the fuel is converted only to CaO and $CO_2$, and not $CaSO_4$. Variations to such treatment become obvious. Note that Eq.(19-corr) employs the corrected oxygen and carbon terms, $\alpha_{3\text{-}corr}$, and $\alpha_{4\text{-}corr}$, used whether or not $\alpha_{CaCO3}$ and/or $\alpha_7$ are employed. For the preferred embodiment $\alpha_{CaCO3}=\alpha_{CaO}=0.0$, and $\alpha_7\geqq 0.0$ whose value as determined by laboratory analysis or other means.

Principally this invention teaches to correct fuel chemist for $CO_2$ produced from inorganic materials when the presence of such $CO_2$ production impacts the accurate study of fossil-fired power plants or steam generators. Such corrected fuel chemistry improves the accuracy of the relationship between Moisture-Ash-Free molar hydrogen versus molar carbon, and the relationship between Moisture-Ash-Free molar oxygen versus molar carbon; whose uses are taught in '711. Correcting fuel chemistry is specifically taught by Eqs.(1) through (5), and elsewhere herein, which procedures are herein termed the "analytical model for fuel chemistry".

In addition, correcting the fuel chemistry for $CO_2$ produced from inorganic materials allows more accurate determination of heating value when such determination is based on operating parameters including combustion effluent measurements, and specifically when such determination is based on the Input/Loss Method as taught in '711. Note that heating value determinations as discussed in '711 [refer to the discussion above Eq.(61) in '711], is dependent not only on $WF_C$, $WF_H$, $WF_O$, and $WF_S$, but also on the oxygen content in the fuel. This is commonly expressed by the ratio of oxygen to carbon found in the fuel. In the example presented in TABLE 1, this ratio varies by 9.5% on a weight base, given only 1% $CO_2$ present in the fuel's mineral matter. Further, the molar quantities $\alpha_{MAF\text{-}4}$ for carbon and $\alpha_{MAF\text{-}3}$ for oxygen as employed in Eqs.(61) and (62) of '711, used to compute heating value, require correction for $CO_2$ present in the fuel's mineral matter using Eqs.(3C) and (4C). Correcting fuel chemistry as therefore required to improve heating value computations used by the Input/Loss Method, or a similar method, as taught herein and in '711, '711 descriptive of additional terms and processes, which procedures are herein termed the "analytical model for heating value".

In addition, when the system heat rate is determined using the Input/Loss Method of '711, or similar method, by combining a computed heating value (HHV) using corrected fuel chemistry, with the system's fuel flow rate ($m_{AF}$) and the system's useful output (such as useful electrical power, P) to produce a heat rate of the system (e.g., for a thermal system generating useful electrical power: $m_{AF}$HHV/P), the procedure is herein termed the "analytical model for heat rate".

In summary, as applied in conjunction with '711, or a similar procedure, this invention teaches a method for quantifying the operation of a fossil-fired thermal system in which a corrected fuel chemistry is being determined by analytical model for fuel chemistry which is dependent on the carbon concentration in its fuel, the method determining the quantity of $CO_2$ produced from inorganic materials associated with a fossil fuel; determining an ultimate analysis of the fossil fuel; determining a set of corrections to the ultimate analysis based on the quantity of $CO_2$ produced from inorganic materials; and finally determining the corrected fuel chemistry based on the set of corrections to the ultimate analysis. Further, this invention teaches a method for determining fuel heating value as determined by an analytical model for heating value which is dependent on the carbon concentration in its fuel, the method determining a quantity of $CO_2$ produced from inorganic materials associated with a fossil fuel; determining an ultimate analysis of the fossil fuel resulting in an uncorrected fuel chemistry determining a set of corrections to the ultimate analysis based on the quantity of $CO_2$ produced from inorganic materials resulting in a corrected fuel chemistry, and finally determining the fuel heating value based on the corrected fuel chemistry used in the analytical model for heating value. Further, this invention teaches a method for determining system heat rate as being determined by analytical models for heat rate and boiler efficiency which are dependent on the carbon concentration in its fuel, the method comprising the determining a quantity of $CO_2$ produced from inorganic materials associated with a fossil fuel; determining an ultimate analysis of the fossil fuel resulting in an uncorrected fuel chemistry, determining a set of corrections to the ultimate analysis based on the quantity of $CO_2$ produced from inorganic materials resulting in a corrected fuel chemistry determining a boiler efficiency based on the corrected fuel chemistry used in the analytical model for boiler efficiency, determining the system heat rate of the fossil-fired thermal system based on the corrected fuel chemistry and the boiler efficiency used in the analytical model for heat rate.

Correcting fuel chemistry for $CO_2$ produced from inorganic materials, and related stoichiometrics associated, for example, with Eq.(19-corr), allows more accurate determination of boiler efficiency given that its presence may effect the combustible and non-combustible contents of the fuel, the calculation of the Enthalpy of Reactants, the effluents, and the calculation of the Enthalpy of Products; these terms and related concepts as taught in '853. Correcting fuel chemistry as therefore required to improve the accuracy in boiler efficiency, as taught herein and in '853, '853 descriptive of additional terms and processes, which are herein termed the "analytical model for boiler efficiency".

In summary, as applied in conjunction with '853, or a similar procedure, this invention teaches a method for determining a high accuracy boiler efficiency as being determined by an analytical model for boiler efficiency which is dependent on the carbon concentration in its fuel, the method comprising determining a quantity of $CO_2$ produced from inorganic materials associated with a fossil fuel; determining an ultimate analysis of the fossil fuel resulting in an uncorrected fuel chemistry, determining a set of corrections to the ultimate analysis based on the quantity of $CO_2$ produced from inorganic materials resulting in a corrected fuel chemistry; determining the high accuracy boiler efficiency based on the corrected fuel chemistry used in the analytical model for boiler efficiency, and monitoring the thermal system using the high accuracy boiler efficiency.

Correcting fuel chemistry for $CO_2$ produced from inorganic materials, with associated procedures, allows more accurate determinations of the $F_C$ Factor determined using EPA procedures; such methods being taught herein, in '956 and in 40CFR Part 60, Appendix A, Method 19. Correcting fuel chemistry for $CO_2$ produced from inorganic materials, with associated procedures, allows more accurate determination of the L Factor via Eq.(72A-corr); such methods being taught herein and in '956. Both $F_C$ Factor and L Factor procedures are dependent on the organic carbon content in the fuel; L Factor procedures are also dependent on understanding the use of Eq.(80-corr). Correcting fuel chemistry, with associated '956 procedures, as therefore required to improve the accuracy in determining an $F_C$ Factor, is herein termed the "analytical model for $F_C$ Factors". Correcting fuel chemistry, with associated '956 procedures, as therefore required to improve the accuracy in determining an L Factor, is herein termed the "analytical model for L Factors".

In summary, as applied in conjunction with '956, or a similar procedure, this invention teaches a method for determining a corrected $F_C$ Factor used by an analytical model for $F_C$ Factors, or a corrected L Factor used by an analytical model for L Factors, which are dependent on the carbon concentration in its fuel, the method determining a quantity of $CO_2$ produced from inorganic materials associated with a fossil fuel; determining an ultimate analysis of the fossil fuel resulting in an uncorrected fuel chemistry, determining a set of corrections to the ultimate analysis based on the quantity of $CO_2$ produced from inorganic materials resulting in a corrected fuel chemistry determining a corrected $F_C$ Factor, or a corrected L Factor, based on the corrected fuel chemistry, and finally determining the emission rate and/or the system heat rate based on the corrected $F_C$ Factor, or corrected L Factor.

Correcting for $CO_2$ produced from inorganic material as taught by this invention, may be incorporated into a heat rate determining apparatus to improve the accuracy of an analytical model for heat rate, including associated analytical models described by Input/Loss methods of '711; the output of the apparatus thereby providing a means to assist in the reduction of heat rate on a continuous operating basis such as on-line monitoring of power plants. Similarly, the method may be incorporated into a fuel chemistry determining device to improve the accuracy of an analytical model for fuel chemistry, including associated analytical models described by Input/Loss procedures of '711. Similarly the method may be incorporated into a fuel heating value determining device to improve the accuracy of an analytical model for heating value, including associated analytical models described by Input/Loss procedures of '711. Similarly the method may be incorporated into a boiler efficiency determining device to improve the accuracy of an analytical model for boiler efficiency, including associated analytical models described by Input/Loss procedures of '853.

An advantage of this invention is to improve the accuracy of current fuel chemistry, heating value, fuel flow, $F_C$ Factor and L Factor determination techniques, including the Input/Loss Method, by accounting for $CO_2$ produced from inorganic materials which may be found in fossil fuels. Without such accuracy improvements, determination techniques would otherwise yield a fuel heating value higher than the true heating value, an As-Fired fuel flow rate lower than the true fuel flow rate, an $F_C$ Factor higher than the true $F_C$ Factor, and an L Factor higher than the true L Factor. A further advantage of this invention is to improve the accuracy of on-line or off-line fuel chemistry, heating value, fuel flow, $F_C$ Factor and L Factor determination devices by incorporating this invention in these devices.

THE DRAWING

FIG. 1 illustrates an important portion of this invention. Box 101 depicts the determination of carbon dioxide content in fuel using a Coulometric instrument Box 103 depicts the obtaining of a laboratory ultimate analysis of a fossil fuel. Box 105 depicts determining a set of corrections to the fuel's ultimate analysis using techniques taught by this invention, specifically use of Eq.(2) resulting in a corrected fuel chemistry. Box 107 depicts the use of the corrected fuel chemistry as a portion of reference fuel characteristics, operating parameters, and other inputs to the Input/Loss Method resulting in a more accurate determination of fuel heating value, boiler efficiency and system heat rate for the actual monitored condition.

For FIG. 1 and elsewhere herein, if used, the words "obtain", "obtained", "obtaining", "determine", "determined", "determining" or "determination" are defined as measuring, calculating, computing, assuming, estimating, processing or gathering from a data base. The words "establish", "established" or "establishing" are defined as measuring, calculating, computing, assuming, estimating, processing or gathering from a data base.

For FIG. 1 and elsewhere herein, the words "monitoring" or "monitored" is meant to encompass on-line or off-line processing of system data, and includes the processing of effluent concentrations, effluent flows and emission rates associated with environmental reporting, and includes the processing and use of L Factors and $F_C$ Factors in determining the thermal performance of a fossil-fired system, and the processing of effluent measurements and operating parameters used in the Input/Loss Method or a similar method.

For FIG. 1 and elsewhere herein, the meaning of the words "elementary composition" when used herein, refers to a fuel's composition by individual elements [for example, as denoted by the $\alpha_i$ terms of Eq.(19-corr)]. An ultimate analysis produces an elementary composition of the fuel analyzed.

For FIG. 1 and elsewhere herein, the meaning of the words "reference fuel characteristics" is defined as including an average or typical fuel chemistry used by the thermal system (the reference fuel chemistry), and its associated Moisture-Ash-Free (MAF) heating value, and preferably these being based on a historical data collection of ultimate analyses. The values of the L Factors, $L_{Ref\text{-}Fuel}$, $L_{Ref\text{-}Water}$ and $L_{Ref\text{-}Ash}$, are included as a portion of reference fuel characteristics, computed using the reference fuel chemistry. Reference fuel characteristics also includes whether the variability of fuel water and fuel ash in the As-Fired condition is predictable, or not. Reference fuel characteristics also contain reasonability limits of the computed elementary composition. Reference fuel characteristics also contain fitting constants which correlate L Factors to effluent concentrations, or to other operating parameters.

For FIG. 1 and elsewhere herein, the words "$CO_2$ producing inorganic materials" or "$CO_2$ produced from inorganic materials" both mean all inorganic materials found in a fossil fuel which, on combustion of the fuel, produce gaseous $CO_2$; these words encompass mineral carbonates found in certain coals, and also extend to free gaseous $CO_2$ found in fossil fuels.

For FIG. 1 and elsewhere herein, the meaning of the words "theoretical combustion" refers to the following conditions associated with the burning of fossil fuels: 1) combustion of fossil fuel with just enough oxygen that no free oxygen is found in the products of combustion; and 2) complete and ideal oxidation occurs such that no pollutants are found in the products of combustion (e.g., CO, NO, $SO_3$, unburned fuel, etc. are not present), the products of combustion consisting only of $CO_2$, $SO_2$ and $N_2$. The words "theoretical combustion" and "stoichiometric combustion" mean the same.

For FIG. 1 and elsewhere herein, the following discusses and defines meaning of the words "operating parameters" as obtained from a thermal system as applicable to this invention. Effluent $CO_2$, $O_2$, $NO_X$, and $SO_2$ measurements (at either the system's effluent stream or "smoke stack", or at the air pre-heater inlet termed the "boiler" side of the air pre-heater) are operating parameters. Indicated wet-base combustion Air/Fuel mass ratio and effluent $H_2O$ measurements, or assumptions of these terms depending on the reference fuel characteristics and appropriate error analyses, are operating parameters. However, the Air/Fuel ratio is only required if computing a variable fuel ash concentration as taught in '711. Effluent temperature, that is the average temperature associated with the combustion gases at the boundary of the system, is part of the operating parameters. The inlet/outlet ratio of $CO_2$, CO, or $O_2$ across the air pre-heater, or its assumptions of such ratios, leading to the determination of an Air Pre-Heater Leakage Factor are operating parameters (refer to the $R_{Act}$ and $\beta$ terms further discussed in '711). Fuel temperature at an appropriate thermodynamic boundary of the system is part of the operating parameters. Air psychrometric measurements obtained at the boundary of the system are operating parameters. The discharge temperatures of the air as it exits each air heating or cooling device (but before it reacts with the fuel) are operating parameters. Measurements required to determine the total energy flow deposition to the working fluid from the combustion gases are operating parameters. Operating parameters also include similar parameters as these, including any parameter which can directly assist in the understanding of a fossil-fired thermal system.

What is claimed is:

1. A method for quantifying the operation of a fossil-fired thermal system in which a corrected fuel chemistry is being determined by an analytical model for fuel chemistry, the method comprising the steps of:

determining a quantity of $CO_2$ produced from inorganic materials associated with a fossil fuel;

determining an ultimate analysis of the fossil fuel resulting in an uncorrected fuel chemistry;

determining a set of corrections to the ultimate analysis based on the quantity of $CO_2$ produced from inorganic materials; and determining the corrected fuel chemistry based on the set of corrections to the ultimate analysis used in the analytical model for fuel chemistry.

2. The method of claim 1 wherein the step of determining the quantity of $CO_2$ produced from inorganic materials comprises:

determining the quantity of $CO_2$ produced from inorganic materials associated with a fossil fuel using a coulometer instrument.

3. The method of claim 2 wherein the step of determining the quantity of $CO_2$ produced from, inorganic materials comprises:

determining the quantity of $CO_2$ produced from inorganic materials associated with a fossil fuel using a coulometer instrument manufactured by UIC, Inc. of Illinois.

4. The method of claim 1 wherein the step of determining the quantity of $CO_2$ produced from inorganic materials comprises:

determining the quantity of $CO_2$ produced from inorganic materials associated with a fossil fuel based on a procedure substantially specified by ASTM D1756.

5. A method for quantifying the operation of a thermal system burning a fossil fuel in which a fuel heating value of the fossil fuel is being determined by an analytical model for heating value which is dependent on fuel chemistry, the method comprising the steps of:

determining a quantity of $CO_2$ produced from inorganic materials associated with a fossil fuel;

determining an ultimate analysis of the fossil fuel;

applying a set of corrections to the ultimate analysis based on the quantity of $CO_2$ produced from inorganic materials resulting in a corrected fuel chemistry;

determining the fuel heating value of the fossil fuel based on the analytical model for heating value which is dependent on the corrected fuel chemistry; and reporting the fuel heating value.

6. A method for quantifying the operation of a thermal system burning a fossil fuel producing a useful output in which a system heat rate is being determined, the method comprising the steps of:

determining a quantity of $CO_2$ produced from inorganic materials associated with a fossil fuel;

determining an ultimate analysis of the fossil fuel;

applying a set of corrections to the ultimate analysis based on the quantity of $CO_2$ produced from inorganic materials resulting in a corrected fuel chemistry;

determining a heating value of the fossil fuel based on an analytical model for heating value which is dependent on the corrected fuel chemistry;

obtaining a fuel flow of the thermal system;

measuring a useful electrical power generated by the thermal system;

determining the system heat rate of the thermal system based on the heating value, the fuel flow and the useful electrical power; and reporting the system heat rate.

7. An apparatus for determining a fossil fuel chemistry when the fuel contains $CO_2$ producing inorganic materials, said apparatus comprising:

an instrument for measuring a quantity of $CO_2$ produced from inorganic materials;

a means of preparing and testing the fossil fuel in the instrument for measuring a quantity of $CO_2$ resulting in a quantity of $CO_2$ produced from inorganic materials associated with the fossil fuel;

a plurality of instruments for measuring an ultimate analysis;

a means for preparing and testing the fossil fuel for the ultimate analysis using the plurality of instruments for measuring the ultimate analysis, resulting in the ultimate analysis;

a means for determining a set of corrections to the ultimate analysis based on the quantity of $CO_2$ produced from inorganic materials resulting in a corrected fossil fuel chemistry; and a means for reporting the corrected fossil fuel chemistry.

8. The apparatus as in claim 7 wherein the instrument for measuring a quantity of $CO_2$ produced from inorganic materials comprises:

a coulometer instrument to be used for measuring a quantity of $CO_2$ produced from inorganic materials.

9. The Apparatus as in claim 8 wherein the coulometer instrument for measuring a quantity of $CO_2$ produced from inorganic materials comprises:

a coulometer instrument manufactured by UIC, Inc. of Illinois to be used for measuring a quantity of $CO_2$ produced from inorganic materials.

10. An apparatus for determining a heating value of a fossil fuel based on an analytical model for heating value which is dependent on a chemistry of the fossil fuel when the fuel contains $CO_2$ producing inorganic materials, said apparatus comprising:

an instrument for measuring a quantity of $CO_2$ produced from inorganic materials;

a means of preparing and testing the fossil fuel in the instrument for measuring a quantity of $CO_2$, resulting in a quantity of $CO_2$ produced from inorganic materials associated with the fossil fuel;

a plurality of instruments for measuring an ultimate analysis;

a means for preparing and testing the fossil fuel for the ultimate analysis using the plurality of instruments for measuring the ultimate analysis, resulting in an ultimate analysis;

a means for determining a set of corrections to the ultimate analysis based on the quantity of $CO_2$ produced from inorganic materials, resulting in a corrected chemistry of the fossil fuel;

a means for determining the heating value based on the corrected chemistry of the fossil fuel as used in the analytical model for heating value; and a means for reporting the heating value of the fossil fuel.

11. An apparatus for determining a system heat rate of a thermal system burning a fossil fuel producing a useful output, based on an analytical model for heat rate, and based on an analytical model for heating value as based on chemistry of the fossil fuel, when the fuel contains $CO_2$ producing inorganic materials, said apparatus comprising:

an instrument for measuring a quantity of $CO_2$ produced from inorganic materials;

a means of preparing and testing the fossil fuel in the instrument for measuring a quantity of $CO_2$, resulting in a quantity of $CO_2$ produced from inorganic materials associated with the fossil fuel;

a plurality of instruments for measuring an ultimate analysis;

a means for preparing and testing the fossil fuel for the ultimate analysis using the plurality of instruments for measuring the ultimate analysis, resulting in an ultimate analysis;

a means for determining a set of corrections to the ultimate analysis based on the quantity of $CO_2$ produced from inorganic materials, resulting in a corrected chemistry of the fossil fuel;

a means for determining the heating value based on the corrected chemistry of the fossil fuel as used in the analytical model for heating value;

a means for delivering the heating value as an input to the analytical model for heat rate;

a flow measuring device measuring a fuel flow to the thermal system;

a means for delivering the fuel flow as an input to the analytical model for heat rate;

a power measuring device measuring a useful electrical power generated by the thermal system;

a means for delivering the useful electrical power as an input to the analytical model for heat rate;

a means for determining the system heat rate of the thermal system based on the analytical model for heat rate; and reporting the system heat rate.

12. A method for quantifying the operation of a fossil-fired thermal system in which a high accuracy boiler efficiency is being determined by an analytical model for boiler efficiency, the method comprising the steps of:

determining a quantity of $CO_2$ produced from inorganic materials associated with a fossil fuel;

determining an ultimate analysis of the fossil fuel;

determining a set of corrections to the ultimate analysis based on the quantity of $CO_2$ produced from inorganic materials resulting in a corrected fuel chemistry;

determining the high accuracy boiler efficiency based on the corrected fuel chemistry used in the analytical model for boiler efficiency; and the high accuracy boiler efficiency.

13. A method for quantifying the operation of a thermal system burning a fossil fuel in which an emission rate is determined from a $F_C$ Factor based on an analytical model for $F_C$ Factors, said model dependent on a chemistry of the fossil fuel, the method comprising the steps of:

determining a quantity of $CO_2$ produced from inorganic materials associated with the fossil fuel;

determining an ultimate analysis of the fossil fuel;

determining a set of corrections to the ultimate analysis based on the quantity of $CO_2$ produced from inorganic materials resulting in a corrected chemistry of the fossil fuel;

determining a corrected $F_C$ Factor based on the corrected chemistry of the fossil fuel; and determining the emission rate based on the corrected $F_C$ Factor used by the analytical model for $F_C$ Factors.

14. The method of claim 13, wherein the method includes an additional step, after the step of determining the corrected $F_C$ Factor, of determining a system heat rate of the thermal system based on the corrected $F_C$ Factor used by the analytical model for $F_C$ Factors.

15. The method of claim 13 wherein the step of determining the quantity of $CO_2$ produced from inorganic materials comprises:

determining the quantity of $CO_2$ produced from inorganic materials associated with a fossil fuel using a coulometer instrument.

16. The method of claim 15 wherein the step of determining the quantity of $CO_2$ produced from inorganic materials comprises:

determining the quantity of $CO_2$ produced from inorganic materials associated with a fossil fuel using a coulometer instrument manufactured by UIC, Inc. of Illinois.

17. The method of claim 13 wherein the step of determining the quantity of $CO_2$ produced from inorganic materials comprises:

determining the quantity of $CO_2$ produced from inorganic materials associated with a fossil fuel based on a procedure substantially specified by ASTM D1756.

18. A method for quantifying the operation of a thermal system burning a fossil fuel in which an emission rate is determined from a L Factor based on an analytical model for L Factors, said model dependent on a chemistry of the fossil fuel, the method comprising the steps of:

determining a quantity of $CO_2$ produced from inorganic materials associated with a fossil fuel;

determining an ultimate analysis of the fossil fuel;

determining a set of corrections to the ultimate analysis based on the quantity of $CO_2$ produced from inorganic materials resulting in a corrected chemistry of the fossil fuel;

determining a corrected L Factor based on the corrected chemistry of the fossil fuel;

determining the emission rate based on the corrected L Factor used by the analytical model for L Factors.

19. The method of claim 18, wherein the method includes an additional step, after the step of determining the corrected L Factor, of determining a system heat rate of the thermal system based on the corrected L Factor used by the analytical model for L Factors.

* * * * *